US009556397B2

(12) United States Patent
Forbus, Jr.

(10) Patent No.: US 9,556,397 B2
(45) Date of Patent: Jan. 31, 2017

(54) HIGH ELASTOHYDRODYNAMIC SHEAR STRENGTH FLUID COMPOSITIONS

(71) Applicant: Santolubes Incorporation, Spartanburg, SC (US)

(72) Inventor: Thomas Reginald Forbus, Jr., Doylestown, PA (US)

(73) Assignee: Santolubes LLC, Spartanburg, SC (US)

( * ) Notice: Subject to any disclaimer, the term of this patent is extended or adjusted under 35 U.S.C. 154(b) by 62 days.

(21) Appl. No.: 14/051,786

(22) Filed: Oct. 11, 2013

(65) Prior Publication Data

US 2015/0105305 A1 Apr. 16, 2015

(51) Int. Cl.
*B01D 19/04* (2006.01)
*C10M 169/04* (2006.01)

(52) U.S. Cl.
CPC ..... *C10M 169/04* (2013.01); *C10M 2203/045* (2013.01); *C10M 2203/065* (2013.01); *C10M 2207/283* (2013.01); *C10M 2207/2805* (2013.01); *C10M 2207/2835* (2013.01); *C10M 2209/105* (2013.01); *C10M 2209/1055* (2013.01); *C10M 2229/02* (2013.01); *C10M 2229/025* (2013.01); *C10N 2220/022* (2013.01); *C10N 2230/02* (2013.01); *C10N 2230/58* (2013.01); *C10N 2230/68* (2013.01); *C10N 2240/046* (2013.01)

(58) Field of Classification Search
CPC ..... C10M 139/02; C10M 139/04
USPC ..... 508/202, 208, 214
See application file for complete search history.

(56) References Cited

U.S. PATENT DOCUMENTS

| | | | | |
|---|---|---|---|---|
| 4,115,343 | A * | 9/1978 | Guillaume | C10M 171/004 508/214 |
| 4,640,792 | A * | 2/1987 | Groenhof et al. | 252/78.3 |
| 6,667,285 | B1 | 12/2003 | Kawahara et al. | |
| 7,629,303 | B2 * | 12/2009 | Hagemeister | C07C 13/28 508/591 |
| 2004/0242441 | A1 * | 12/2004 | Chiu | C10M 111/02 508/591 |
| 2005/0176594 | A1 * | 8/2005 | Grabowski et al. | 508/215 |
| 2007/0063170 | A1 | 3/2007 | Forbus | |
| 2007/0232506 | A1 * | 10/2007 | Gao | C10M 105/40 508/485 |
| 2010/0130390 | A1 | 5/2010 | Tipton et al. | |
| 2013/0261035 | A1 | 10/2013 | Kovanda et al. | |

OTHER PUBLICATIONS

The International Search Report for International Patent Application No. PCT/US2013/064487, dated Dec. 6, 2013, 3 pages.
The Written Opinion for International Patent Application No. PCT/US2013/064487, dated Dec. 6, 2013, 6 pages.

* cited by examiner

*Primary Examiner* — Prem C Singh
*Assistant Examiner* — Francis C Campanell
(74) *Attorney, Agent, or Firm* — Morgan Lewis & Bockius, LLP

(57) ABSTRACT

A lubrication fluid including cyclic hydrocarbons in combination with dimethylsilicone fluids and/or di-alkyl or di-cycloalkyl or alkyl-cycloalkyl, or mixtures thereof, and di-end-capped polypropylene oxides or highly branched esters to produce very high traction elastohydrodynamic (EHD) traction fluids and to modify the low temperature viscometric properties of the mixed fluids without adversely affecting the very high elastohydrodynamic shear strength or traction coefficients of the very high shear strength cyclic hydrocarbon fluid in the resulting mixed fluids with improved low temperature viscosity.

8 Claims, No Drawings

HIGH ELASTOHYDRODYNAMIC SHEAR STRENGTH FLUID COMPOSITIONS

FIELD OF THE INVENTION

The present invention involves the use of dimethylsilicone fluids of moderate viscosity and/or di-alkyl or di-cycloalkyl or alkyl-cycloalkyl, or mixtures thereof, of di-end-capped polypropylene oxides or of ester compounds in combination with cyclic hydrocarbons to produce very high shear strength elastohydrodynamic (EHD) traction fluids and to modify the low temperature viscometric properties of the mixed fluids without adversely affecting the very high elastohydrodynamic shear strength or traction coefficients of the very high shear strength cyclic hydrocarbon fluid in the resulting mixed fluids with improved low temperature viscosity.

BACKGROUND OF THE INVENTION

Elastohydrodynamic traction drives are power transmission devices that operate by transmitting torque through a thin elastohydrodynamic film of fluid between nominally-smooth, rolling-sliding, highly-loaded contacts. The efficient transfer of torque relies upon the high-stress shear strength of the fluid used to lubricate the surfaces in these high-stress elastically-deformed contacts. Fluids with very high elastohydrodynamic shear strength, or high traction coefficients, enable the most efficient transfer of torque through these contacts from one surface to the other. Thus, the shear strength properties of the fluid under the EHD contact operational conditions effectively dictate the sizing of the device for a given power or torque transfer requirement. Or, in any given size of an EHD traction transmission, determines the loading of the contact, the contact stress, required to produce a required torque through the device and thus has a large impact on the durability of the traction drive components. Prior art fluids are described in U.S. Pat. No. 7,645,395 and references therein.

SUMMARY OF THE INVENTION

The present disclosure provides for, in one embodiment, a lubrication fluid including a dimethylsiloxane fluid having a viscosity of 20 cS at 77° F. or greater in combination with a polycyclic hydrocarbon fluid. The dimethylsiloxane fluid does not contain more than 10 wt. % of functional groups other than methyl functional groups so to modify the low temperature properties of polycyclic hydrocarbons fluids. In one embodiment, the dimethylsiloxane fluid has a viscosity of 20 cS but not greater than 50 cS at 77° F.

The present disclosure provides for, in another embodiment, a lubrication fluid including dimethylsiloxane fluid having a viscosity of 20 cS at 77° F. or greater in combination with oil-soluble di-end-capped polypropyleneoxide compounds and a polycyclic hydrocarbon fluid. The dimethylsiloxane fluid does not contain more than 10 wt. % of functional groups other than methyl functional groups so to modify the low temperature properties of polycyclic hydrocarbons fluids. In one embodiment, the dimethylsiloxane fluid has a viscosity of 20 cS but not greater than 50 cS at 77° F.

The present disclosure provides for, in yet another embodiment, the lubrication fluid including a dimethylsiloxane compound having a viscosity range of 20 cSt at 77° F. or greater in combination with a polycyclic hydrocarbon fluid and an ester compound independently selected from: a branched alkyl ester, a cycloester, a cycloalkyl ester and combinations thereof. The dimethylsiloxane fluid does not contain more than 10 wt. % of functional groups other than methyl functional groups.

DETAILED DESCRIPTION OF THE EMBODIMENTS

The present invention provides for formulations for lubricants of high elastohydrodynamic shear strength or traction coefficients and good low temperature rheology. This combination of properties is generally known in the art to be very difficult to achieve. Historically, achieving fluid formulations with good low temperature rheological properties has always compromised elastohydrodynamic shear strength to some degree. The various formulation embodiments described herein eliminate these losses and in some cases the formulation scheme actually is found to improve elastohydrodynamic shear strength under certain operational conditions in elastohydrodynamic traction contacts while achieving good low temperature rheological properties suitable for all-weather operations.

In one embodiment, the lubrication fluid comprises a dimethylsiloxane fluid having a viscosity of 20 cS at 77° F. or greater in combination with a polycyclic hydrocarbon fluid wherein the dimethylsiloxane fluid does not contain more than 10 wt. % of functional groups other than methyl functional groups so to modify the low temperature properties of polycyclic hydrocarbons fluids. In one embodiment, the dimethylsiloxane fluid has a viscosity of 20 cS but not greater than 50 cS at 77° F.

In another embodiment, the lubrication fluid consists essentially of dimethylsiloxane fluid having a viscosity of 20 cS at 77° F. or greater in combination with a polycyclic hydrocarbon fluid, wherein the dimethylsiloxane fluid does not contain more than 10 wt. % of functional groups other than methyl functional groups so to modify the low temperature properties of polycyclic hydrocarbons fluids. In one embodiment, the dimethylsiloxane fluid has a viscosity of 20 cS but not greater than 50 cS at 77° F.

In yet another embodiment, the lubrication fluid comprises dimethylsiloxane fluid having a viscosity of 20 cS at 77° F. or greater in combination with oil-soluble di-end-capped polypropyleneoxide compounds and a polycyclic hydrocarbon fluid, wherein the dimethylsiloxane fluid does not contain more than 10 wt. % of functional groups other than methyl functional groups so to modify the low temperature properties of polycyclic hydrocarbons fluids. In one embodiment, the dimethylsiloxane fluid has a viscosity of 20 cS but not greater than 50 cS at 77° F.

In still yet another embodiment, the lubrication fluid consists essentially of dimethylsiloxane fluid having a viscosity of 20 cS at 77° F. or greater in combination in combination with oil-soluble di-end-capped polypropyleneoxide compounds and a polycyclic hydrocarbon fluid, wherein the dimethylsiloxane fluid does not contain more than 10 wt. % of functional groups other than methyl functional groups so to modify the low temperature properties of polycyclic hydrocarbons fluids. In one embodiment, the dimethylsiloxane fluid has a viscosity of 20 cS but not greater than 50 cS at 77° F.

In yet another embodiment, the lubrication fluid comprises a dimethylsiloxane compound having a viscosity range of 20 cSt at 77° F. or greater in combination with a polycyclic hydrocarbon fluid and an ester compound independently selected from: a branched alkyl ester, a cycloester, a cycloalkyl ester and combinations thereof. The dimethylsiloxane fluid does not contain more than 10 wt. % of functional groups other than methyl functional groups.

In still yet another embodiment, the lubrication fluid consists essentially of a dimethylsiloxane compound having a viscosity range of 20 cSt at 77° F. or greater in combination with a polycyclic hydrocarbon fluid and an ester compound independently selected from: a branched alkyl ester, a cycloester, a cycloalkyl ester and combinations thereof. The dimethylsiloxane fluid does not contain more than 10 wt. % of functional groups other than methyl functional groups.

For the purposes of this disclosure, consists essentially of excludes the inclusion of any component that materially changes the low temperature properties of polycyclic hydrocarbons fluids.

It was unexpectedly found that addition of dimethylsiloxane fluids to polycyclic hydrocarbons fluid with or without oil-soluble di-end-capped polypropylene oxide compounds results in a lubrication fluid having improved low temperature properties without degrading the desired elastohydrodynamic shear strength properties or traction coefficients of the binary or ternary lubrication fluid relative to the polycyclic hydrocarbons fluid alone.

It was further was unexpectedly found that addition of dimethylsiloxane fluids to polycyclic hydrocarbons fluid with branched ester, cycloester or cycloalkyl ester compounds results in a lubrication fluid having improved low temperature properties without degrading the desired elastohydrodynamic shear strength properties or traction coefficients of the binary or ternary lubrication fluid relative to the polycyclic hydrocarbons fluid alone.

Base Oils

The present invention provides for a lubrication fluid based on a polycyclic hydrocarbon fluid which exhibits good shear strength but poor low temperature properties. In some embodiments, the polycyclic hydrocarbon fluid is a perhydro dimer of alpha-methylstyrene. In some another embodiments, the polycyclic hydrocarbon fluid is a perhydro linear dimer of alpha-methylstyrene.

In one embodiment, the polycyclic hydrocarbon fluid may be combined with a dimethylsiloxane fluid having a viscosity of at least 20 cS at 77° F. or greater wherein the dimethylsiloxane fluid contains no more than 10 wt. % of functional groups other than methyl functional groups. The dimethylsiloxane fluid may be used at an amount ranging from 0.1 wt. to 25 wt. %.

In another embodiment, the polycyclic hydrocarbon fluid may be combined with a dimethylsiloxane fluid having a viscosity of at least 20 cS at 77° F. or greater and oil-soluble di-end-capped polypropylene oxide compounds wherein the dimethylsiloxane fluid contains no more than 10 wt. % of functional groups other than methyl functional groups. The dimethylsiloxane fluid may be used at an amount ranging from 0.1 wt. to 25 wt. %. The oil-soluble di-end-capped polypropylene oxide compound may be used at an amount ranging from 0.1 wt. to 25 wt. %. In one such embodiment, the di-end-capped polypropylene oxide compounds may contain alkyl groups, cycloaliphatic rings, aromatic rings or combinations of these organic groups as the end-capping organic groups. In one embodiment, the end-capping organic groups have one to ten carbon atoms.

In another embodiment, the polycyclic hydrocarbon fluid may be combined with a dimethylsiloxane fluid having a viscosity of at least 20 cS at 77° F. or greater and branched ester, cycloester or cycloalkyl ester compounds wherein the dimethylsiloxane fluid contains no more than 10 wt. % of functional groups other than methyl functional groups. The dimethylsiloxane fluid may be used at an amount ranging from 0.1 wt. to 25 wt. %. The branched ester, cycloester, cycloalkyl ester compounds and combinations thereof may be used at an amount ranging from 0.1 wt. to 25 wt. %.

In one embodiment, the ester compound is a branched alkyl ester having 6 to 12 carbon atoms in the branched alkyl group and 3 to 4 ester groups. In one embodiment, the branched alkyl ester has at least two methyl groups distributed along the backbone of the branched alkyl ester. In another embodiment, the branched alkyl ester has at least one branching methyl or branching alkyl group per two carbon atoms located along the backbone of the branched alkyl ester. In one embodiment, the branched alkyl ester is trimethylhexane trimethoxypropane ester. In another embodiment, the branched alkyl ester is trimethylhexane pentaerithritol ester.

In one embodiment, the ester compound is a cycloester or cycloalkyl ester compound selected from cyclohexyl group or alkyl cyclohexyl group having 6 to 10 carbon atoms and 3 to 4 ester groups. In one embodiment, the cycloester compound independently includes tri-(cyclohexyl) trimethoxypropane and tri-(cyclohexyl)pentaerithritol. In another embodiment, the cycloalkyl ester compound independently includes (alkyl branched-cyclohexyl)trimethoxypropane and tri-(alkyl branched-cyclohexyl)pentaerithritol. Examples include (methyl branched-cyclohexyl) trimethoxypropane and tri-(methylcyclohexyl)pentaerithritol. In some such embodiments, the number of methyl groups attached to the cyclohexyl group ranges from 1 to 3.

In one embodiment, the dimethylsiloxane fluid may have other functional groups including, but are not limited to, higher alkyl groups, cycloaliphatic rings, aromatic rings or a combination of these non-methyl organic groups. In yet another embodiment, the dimethylsiloxane fluids may be produced as purely dimethyl-derivatives.

The viscosity grades of such dimethylsiloxane fluids have the added advantage of being relatively non-volatile at typical lubricant or transmission operation temperatures in a EHD traction drive or traction drive transmission of at least 20 cS at 77° F. and higher. For example, typically 10 cSt (at 77° F.) dimethylsiloxane has a volatility of 50 wt % at 150° C. relative to 20 cSt dimethylsiloxane which typically has only a 5% volatility at 150° C.

In one embodiment, the dimethylsiloxane fluid has a viscosity greater than 20 cSt at 77° F. but not greater than 50 cS at 77° F. and may be used at an amount ranging from 0.1 wt. to 25 wt. %. In one embodiment, the dimethylsiloxane fluid has a viscosity greater than 25 cSt at 77° F. but not greater than 50 cS at 77° F. and may be used at an amount ranging from 0.1 wt. to 25 wt. %. In one embodiment, the dimethylsiloxane fluid has a viscosity greater than 30 cSt at 77° F. but not greater than 50 cS at 77° F. and may be used at an amount ranging from 0.1 wt. to 25 wt. %. In yet another embodiment, the dimethylsiloxane fluid has a viscosity of greater than 40 cSt at 77° F. but not greater than 50 cS at 77° F. and may be used at an amount ranging from 0.1 wt. to 25 wt. %. The higher viscosity versions are contemplated to be appropriate when higher viscosity grade elastohydrodynamic traction fluid lubricants are desired whereby higher formulation concentrations are needed to significantly modify the low temperature rheology of the finished fluids which results in finished fluids with kinematic viscosities of about 4.0 cSt or above, measured at 100° C.

The lubrication fluids described herein can serve as base fluids for the formulation of high elastohydrodynamic shear strength fluids for use in elastohydrodynamic continuously or infinitely variable transmission or in elastohydrodynamic traction drives in general. To these combination base fluids appropriate lubricant performance additives may be added to complete the formulation of the transmission or traction drive fluid. These additives may include antioxidants, anti-wear agents, anti-corrosion agents, anti-foamants, anti-rust agents, detergents, dispersants, extreme-pressure agents, friction modifiers, seal swell agents and/or viscosity modifier additives.

The various embodiments of the lubrication fluids described herein allow for production of useful fully-formulated EHD traction fluids having kinematic viscosities of from about 3.7 to 4.5 cS at 100° C. and low temperature dynamic viscosities ranging from 28,000 cP down to about 5,000 cP which do not compromise EHD shear strength properties to any appreciable degree.

The following examples describe various embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples, all percentages are given on a weight basis unless otherwise indicated.

In the below examples, the following abbreviations are used: Sep=Separation; No Sep=Separation; SCL—Slightly Cloudy; and Cl—Cloudy

Comparative Example

Lubrication Fluid Containing Perhydro-Alpha-Methylstyrene Dimer

| Component | wt. % |
|---|---|
| Perhydro-alpha-Methylstyrene Dimer | 96.8 |
| Poly-Propylene Oxide Fluid | |
| Dimethylsiloxane, 20 cSt @ 77 F. | |
| Dimethylsiloxane, 30 cSt @ 77 F. | |
| Performance Additive Package | 3.0 |
| Anti-Foamant Package | 0.2 |
| | 100.00 |

| Test | Units |
|---|---|
| CS 40 C., cS | 20.15 |
| CS 100 C., cS | 3.66 |
| VI | 31 |
| Anton Paar SVM, −20 C., cP | 4813 |
| Anton Paar SVM, −30 C., cP | 31182 |

-continued

| Appearance (24 hrs @ temperature) | |
|---|---|
| 70 F. | C |
| 35 F. | C |
| 0 F. | No Sep |

Example 1

Lubrication Fluid Containing Perhydro-Alpha-Methylstyrene Dimer and Poly-Propylene Oxide

| Component | Wt. % | Wt. % | Wt. % |
|---|---|---|---|
| Perhydro-alpha-Methylstyrene Dimer | 91.80 | 86.80 | 81.80 |
| Poly-Propylene Oxide Fluid | 5.00 | 10.00 | 15.00 |
| Dimethylsiloxane, 20 cSt @ 77 F. | | | |
| Performance Additive Package | 3.00 | 3.00 | 3.00 |
| Anti-Foamant Package | 0.20 | 0.20 | 0.20 |
| | 100.00 | 100.00 | 100.00 |

| Test | Unit | Unit | Unit |
|---|---|---|---|
| CS 40 C., cS | 18.63 | 20.09 | 19.69 |
| CS 100 C., cS | 3.66 | 3.89 | 3.96 |
| VI | 63 | 74 | 92 |
| Anton Paar SVM, −20 C., cP | 4440 | 3258 | 3333 |
| Anton Paar SVM, −30 C., cP | 27609 | 20094 | 23088 |
| Brookfield, −30 C., cP | | | |
| Appearance, 24 hrs @ temp | | | |
| 70-75 F. | C | C | C |
| 35-40 F. | C | C | C |
| 0-5 F. | No Sep | No Sep | No Sep |

Example 2

Lubrication Fluid Containing Perhydro-Alpha-Methylstyrene Dimer, Poly-Propylene Oxide and Dimethylsiloxane, 20 cSt @ 77° F.

| Component | Wt. % | Wt. % | Wt. % | Wt. % | Wt. % | Wt. % | Wt. % |
|---|---|---|---|---|---|---|---|
| Perhydro-alpha-Methylstyrene Dimer | 86.80 | 81.80 | 76.80 | 71.80 | 66.80 | 81.80 | 76.80 |
| Poly-Propylene Oxide Fluid | 5.00 | 5.00 | 5.00 | 5.00 | 5.00 | 10.00 | 10.00 |
| Dimethylsiloxane, 20 cSt @ 77 F. | 5.00 | 10.00 | 15.00 | 20.00 | 25.00 | 5.00 | 10.00 |
| Performance Additive Package | 3.00 | 3.00 | 3.00 | 3.00 | 3.00 | 3.00 | 3.00 |
| Anti-Foamant Package | 0.20 | 0.20 | 0.20 | 0.20 | 0.20 | 0.20 | 0.20 |
| | 100.00 | 100.00 | 100.00 | 100.00 | 100.00 | 100.00 | 100.00 |

| Test | Unit | Unit | Unit | Unit | Unit | Unit | Unit |
|---|---|---|---|---|---|---|---|
| CS 40 C., cS | 18.80 | 18.65 | 17.32 | 16.46 | 14.69 | 19.50 | 18.55 |
| CS 100 C., cS | 3.77 | 3.92 | 4.04 | 4.10 | 3.98 | 4.05 | 4.08 |
| VI | 79 | 103 | 136 | 150 | 183 | 105 | 121 |
| Anton Paar SVM, −20 C., cP | 2547 | 1672 | 1166 | 774 | 641 | 2149 | 1541 |
| Anton Paar SVM, −30 C., cP | 13818 | 8689 | 6026 | 3759 | 3153 | 11471 | 7886 |
| Brookfield, −30 C., cP | | 9118 | | | | | 7728 |
| Appearance, 24 hrs @ temp | | | | | | | |
| 70-75 F. | C | C | C | C | C | C | C |
| 35-40 F. | C | C | C | C | C | C | C |
| 0-5 F. | No Sep | No Sep | No Sep | No Sep | No Sep | No Sep | No Sep |

-continued

| Component | Wt. % | Wt. % | Wt. % | Wt. % | Wt. % | Wt. % | Wt. % | Wt. % |
|---|---|---|---|---|---|---|---|---|
| Perhydro-alpha-Methylstyrene Dimer | 71.80 | 66.80 | 61.80 | 76.80 | 71.80 | 66.80 | 61.80 | 56.80 |
| Poly-Propylene Oxide Fluid | 10.00 | 10.00 | 10.00 | 15.00 | 15.00 | 15.00 | 15.00 | 15.00 |
| Dimethylsiloxane, 20 cSt @ 77 F. | 15.00 | 20.00 | 25.00 | 5.00 | 10.00 | 15.00 | 20.00 | 25.00 |
| Performance Additive Package | 3.00 | 3.00 | 3.00 | 3.00 | 3.00 | 3.00 | 3.00 | 3.00 |
| Anti-Foamant Package | 0.20 | 0.20 | 0.20 | 0.20 | 0.20 | 0.20 | 0.20 | 0.20 |
| | 100.00 | 100.00 | 100.00 | 100.00 | 100.00 | 100.00 | 100.00 | 100.00 |
| Test | Unit | Unit | Unit | Unit | Unit | Unit | Unit | Unit |
| CS 40 C., cS | 17.59 | 16.48 | 14.92 | 18.47 | 17.22 | 17.20 | 17.14 | 16.77 |
| CS 100 C., cS | 4.15 | 4.15 | 4.13 | 4.00 | 4.03 | 4.22 | 4.37 | 4.49 |
| VI | 143 | 163 | 197 | 114 | 137 | 158 | 177 | 198 |
| Anton Paar SVM, −20 C., cP | 914 | 706 | 624 | 2165 | 1398 | 953 | 811 | 689 |
| Anton Paar SVM, −30 C., cP | 4384 | 3272 | 2859 | 12378 | 7440 | 4667 | 3646 | 2804 |
| Brookfield, −30 C., cP | | | | | | | | |
| Appearance, 24 hrs @ temp | | | | | | | | |
| 70-75 F. | C | C | C | C | C | C | C | C |
| 35-40 F. | C | C | C | C | C | C | C | C |
| 0-5 F. | No Sep | No Sep | No Sep | No Sep | No Sep | No Sep | No Sep | No Sep |

Example 3

Lubrication Fluid Containing Perhydro-Alpha-Methylstyrene Dimer, Poly-Propylene Oxide and Dimethylsiloxane, 30 cSt @ 77° F.

| Component | Wt. % | Wt. % | Wt. % | Wt. % | Wt. % | Wt. % | Wt. % |
|---|---|---|---|---|---|---|---|
| Perhydro-alpha-Methylstyrene Dimer | 86.80 | 81.80 | 76.80 | 71.80 | 66.80 | 81.80 | 76.80 |
| Poly-Propylene Oxide Fluid | 5.00 | 5.00 | 5.00 | 5.00 | 5.00 | 10.00 | 10.00 |
| Shin Etsu DC200, 30 cSt | 5.00 | 10.00 | 15.00 | 20.00 | 25.00 | 5.00 | 10.00 |
| Performance Additive Package | 3.00 | 3.00 | 3.00 | 3.00 | 3.00 | 3.00 | 3.00 |
| Anti-Foamant Package | 0.20 | 0.20 | 0.20 | 0.20 | 0.20 | 0.20 | 0.20 |
| Test | Unit | Unit | Unit | Unit | Unit | Unit | Unit |
| CS 40 C., cS | 19.42 | 18.36 | 18.05 | 17.26 | 17.35 | 18.94 | 19.56 |
| CS 100 C., cS | 3.81 | 4.03 | 4.20 | 4.32 | 4.54 | 4.00 | 4.32 |
| VI | 73 | 118 | 141 | 168 | 192 | 107 | 131 |
| Anton Paar SVM, −20 C., cP | 3225 | 2078 | 1778 | | | 2270 | 1818 |
| Anton Paar SVM, −30 C., cP | 19186 | 11296 | 9398 | | | 12944 | 9756 |
| Appearance, 24 hrs @ temp | | | | | | | |
| 70-75 F. | C | C | C | C | C | C | C |
| 35-40 F. | C | SCL | SCL | Sep | Sep | C | SCL |
| 0-5 F. | No Sep | No Sep | No Sep | | | No Sep | No Sep |

| Component | Wt. % | Wt. % | Wt. % | Wt. % | Wt. % | Wt. % | Wt. % | Wt. % |
|---|---|---|---|---|---|---|---|---|
| Perhydro-alpha-Methylstyrene Dimer | 71.80 | 66.80 | 61.80 | 76.80 | 71.80 | 66.80 | 61.80 | 56.80 |
| Poly-Propylene Oxide Fluid | 10.00 | 10.00 | 10.00 | 15.00 | 15.00 | 15.00 | 15.00 | 15.00 |
| Shin Etsu DC200, 30 cSt | 15.00 | 20.00 | 25.00 | 5.00 | 10.00 | 15.00 | 20.00 | 25.00 |
| Performance Additive Package | 3.00 | 3.00 | 3.00 | 3.00 | 3.00 | 3.00 | 3.00 | 3.00 |
| Anti-Foamant Package | 0.20 | 0.20 | 0.20 | 0.20 | 0.20 | 0.20 | 0.20 | 0.20 |
| | 100.00 | 100.00 | 100.00 | 100.00 | 100.00 | 100.00 | 100.00 | 100.00 |
| Test | Unit | Unit | Unit | Unit | Unit | Unit | Unit | Unit |
| CS 40 C., cS | 19.22 | | | 20.44 | 20.16 | 19.74 | 19.57 | 19.03 |
| CS 100 C., cS | 4.50 | | | 4.38 | 4.52 | 4.67 | 4.82 | 5.00 |

-continued

| | | | | | | | | |
|---|---|---|---|---|---|---|---|---|
| VI | 155 | | | 126 | 143 | 163 | 181 | 209 |
| Anton Paar SVM, −20 C., cP | | | | 2338 | | | | |
| Anton Paar SVM, −30 C., cP | | | | 14450 | | | | |
| Appearance, 24 hrs @ temp | | | | | | | | |
| 70-75 F. | C | C | C | C | C | C | C | C |
| 35-40 F. | Sep | Sep | Sep | C | CL | CL | CL | Sep |
| 0-5 F. | | | | No Sep | | | | |

Example 4

Lubrication Fluid Containing Perhydro-Alpha-Methylstyrene Dimer, Poly-Propylene Oxide and Dimethylsiloxane, 50 cSt @ 77° F.

| Component | Wt. % | Wt. % | Wt. % | Wt. % | Wt. % | Wt. % | Wt. % |
|---|---|---|---|---|---|---|---|
| Perhydro-alpha-Methylstyrene Dimer | 86.80 | 81.80 | 76.80 | 71.80 | 66.80 | 81.80 | 76.80 |
| Poly-Propylene Oxide Fluid | 5.00 | 5.00 | 5.00 | 5.00 | 5.00 | 10.00 | 10.00 |
| Dimethylsiloxane, 50 cSt @ 77 F. | 5.00 | 10.00 | 15.00 | 20.00 | 25.00 | 5.00 | 10.00 |
| Performance Additive Package | 3.00 | 3.00 | 3.00 | 3.00 | 3.00 | 3.00 | 3.00 |
| Anti-Foamant Package | 0.20 | 0.20 | 0.20 | 0.20 | 0.20 | 0.20 | 0.20 |
| | 100.00 | 100.00 | 100.00 | 100.00 | 100.00 | 100.00 | 100.00 |
| Test | | | | | | | |
| CS 40 C., cS | | | | | | | |
| CS 100 C., cS | | | | | | | |
| VI | | | | | | | |
| Anton Paar SVM, −20 C., cP | | | | | | | |
| Anton Paar SVM, −30 C., cP | | | | | | | |
| Appearance, 24 hrs @ temp | | | | | | | |
| 70-75 F. | SCl | Sep | Sep | Sep | Sep | SCl | Sep |
| 35-40 F. | Sep | Sep | Sep | Sep | Sep | Sep | Sep |
| 0-5 F. | | | | | | | |

| Component | Wt. % | Wt. % | Wt. % | Wt. % | Wt. % | Wt. % | Wt. % | Wt. % |
|---|---|---|---|---|---|---|---|---|
| Perhydro-alpha-Methylstyrene Dimer | 71.80 | 66.80 | 61.80 | 76.80 | 71.80 | 66.80 | 61.80 | 56.80 |
| Poly-Propylene Oxide Fluid | 10.00 | 10.00 | 10.00 | 15.00 | 15.00 | 15.00 | 15.00 | 15.00 |
| Dimethylsiloxane, 50 cSt @ 77 F. | 15.00 | 20.00 | 25.00 | 5.00 | 10.00 | 15.00 | 20.00 | 25.00 |
| Performance Additive Package | 3.00 | 3.00 | 3.00 | 3.00 | 3.00 | 3.00 | 3.00 | 3.00 |
| Anti-Foamant Package | 0.20 | 0.20 | 0.20 | 0.20 | 0.20 | 0.20 | 0.20 | 0.20 |
| | 100.00 | 100.00 | 100.00 | 100.00 | 100.00 | 100.00 | 100.00 | 100.00 |
| Test | | | | | | Unit | | |
| CS 40 C., cS | | | | 21.000 | | | | |
| CS 100 C., cS | | | | 4.42 | | | | |
| VI | | | | 122 | | | | |
| Anton Paar SVM, −20 C., cP | | | | 2713 | | | | |
| Anton Paar SVM, −30 C., cP | | | | 17492 | | | | |
| Appearance, 24 hrs @ temp | | | | | | | | |
| 70-75 F. | Sep | Sep | Sep | C | Sep | Sep | Sep | Sep |
| 35-40 F. | Sep | Sep | Sep | C | Sep | Sep | Sep | Sep |
| 0-5 F. | | | | No Sep | | | | |

Example 5

Lubrication Fluid Containing Perhydro-Alpha-Methylstyrene Dimer with or without Poly-Propylene Oxide and with or without Dimethylsiloxane, 20 cSt @ 77° F. or 30 cSt @ 77° F.

| Component | Wt. % | Wt. % | Wt. % | Wt. % | Wt. % | Wt. % | Wt. % | Wt. % |
|---|---|---|---|---|---|---|---|---|
| Perhydro-alpha-Methylstyrene Dimer | 91.8 | 86.8 | 81.8 | 76.8 | 71.8 | 91.8 | 86.8 | 81.8 |
| Poly-Propylene Oxide Fluid | 5.0 | 10.0 | 15.0 | 20.0 | 25.0 | | | |
| Dimethylsiloxane, 20 cSt @ 77 F. | | | | | | 5.0 | 10.0 | 15.0 |
| Dimethylsiloxane, 30 cSt @ 77 F. | | | | | | | | |
| Performance Additive Package | 3.0 | 3.0 | 3.0 | 3.0 | 3.0 | 3.0 | 3.0 | 3.0 |
| Anti-Foamant Package | 0.2 | 0.2 | 0.2 | 0.2 | 0.2 | 0.2 | 0.2 | 0.2 |
| | 100.00 | 100.00 | 100.00 | 100.00 | 100.00 | 100.00 | 100.00 | 100.00 |
| Test | Unit | Unit | Unit | Unit | Unit | Unit | Unit | Unit |
| CS 40 C., cS | 20.36 | 20.78 | 21.12 | 21.43 | 21.96 | 18.92 | 17.67 | 16.94 |
| CS 100 C., cS | 3.76 | 3.92 | 4.00 | 4.15 | 4.41 | 3.72 | 3.76 | 3.88 |
| VI | 46 | 66 | 73 | 90 | 110 | 68 | 100 | 124 |
| Anton Paar SVM, −20 C., cP | 4248 | 3798 | 3788 | 3857 | 3916 | 2907 | 1967 | 1447 |
| Anton Paar SVM, −30 C., cP | 26364 | 25216 | 25883 | 26634 | 27137 | 16999 | 11244 | 8057 |
| Appearance (24 hrs @ temperature) | | | | | | | | |
| 70 F. | C | C | C | C | C | C | C | C |
| 35 F. | C | C | C | C | C | C | C | C |
| 0 F. | No Sep | No Sep | No Sep | No Sep | No Sep | No Sep | No Sep | No Sep |

| Component | Wt. % | Wt. % | Wt. % | Wt. % | Wt. % | Wt. % | Wt. % | Wt. % |
|---|---|---|---|---|---|---|---|---|
| Perhydro-alpha-Methylstyrene Dimer | 76.8 | 71.8 | 96.8 | 91.8 | 86.8 | 81.8 | 76.8 | 71.8 |
| Poly-Propylene Oxide Fluid | 20.0 | 25.0 | | | | | | |
| Dimethylsiloxane, 20 cSt @ 77 F. | | | | 5.0 | 10.0 | 15.0 | 20.0 | 25.0 |
| Dimethylsiloxane, 30 cSt @ 77 F. | | | | | | | | |
| Performance Additive Package | 3.0 | 3.0 | 3.0 | 3.0 | 3.0 | 3.0 | 3.0 | 3.0 |
| Anti-Foamant Package | 0.2 | 0.2 | 0.2 | 0.2 | 0.2 | 0.2 | 0.2 | 0.2 |
| | 100.00 | 100.00 | 100.00 | 100.00 | 100.00 | 100.00 | 100.00 | 100.00 |
| Test | Unit | Unit | Unit | Unit | Unit | Unit | Unit | Unit |
| CS 40 C., cS | 16.08 | 15.58 | 20.32 | 19.31 | 18.59 | 17.93 | 17.48 | 15.72 |
| CS 100 C., cS | 3.90 | 4.03 | 3.67 | 3.80 | 3.94 | 4.07 | 4.22 | 4.08 |
| VI | 141 | 167 | 31 | 74 | 106 | 129 | 153 | 171 |
| Anton Paar SVM, −20 C., cP | 1186 | 938 | 5161 | 3149 | 2388 | 1985 | 1534 | 956 |
| Anton Paar SVM, −30 C., cP | 6473 | 5207 | 33580 | 19169 | 13640 | 11172 | 7600 | 5352 |
| Appearance (24 hrs @ temperature) | | | | | | | | |
| 70 F. | C | C | C | C | C | C | C | C |
| 35 F. | C | C | C | C | C | C | C | C |
| 0 F. | No Sep | No Sep | No Sep | No Sep | No Sep | No Sep | Sep | Sep |

Example 6

Lubrication Fluid Containing Perhydro-Alpha-Methylstyrene Dimer and Dimethylsiloxane, 50 cSt @ 77° F.

| Component | Wt. % | Wt. % | Wt. % | Wt. % | Wt. % | Wt. % |
|---|---|---|---|---|---|---|
| Perhydro-alpha-Methylstyrene Dimer | 96.8 | 91.8 | 86.8 | 81.8 | 76.8 | 71.8 |
| Poly-Propylene Oxide Fluid | | | | | | |
| Dimethylsiloxane, 50 cSt @ 77 F. | | 5.00 | 10.00 | 15.00 | 20.00 | 25.00 |
| Performance Additive Package | 3.00 | 3.00 | 3.00 | 3.00 | 3.00 | 3.00 |
| Anti-Foamant Package | 0.20 | 0.20 | 0.20 | 0.20 | 0.20 | 0.20 |
| | 100.00 | 100.00 | 100.00 | 100.00 | 100.00 | 100.00 |
| Test | Unit | Unit | Unit | Unit | Unit | Unit |
| CS 40 C., cS | 20.32 | 19.80 | 20.20 | 19.80 | 19.50 | |
| CS 100 C., cS | 3.67 | 3.87 | 4.23 | 4.08 | 4.34 | |
| VI | 31 | 76 | 114 | 105 | 134 | |
| Anton Paar SVM, −20 C., cP | 5161 | 3370 | 2785 | | | |
| Anton Paar SVM, −30 C., cP | 33580 | 22050 | 16010 | | | |
| Appearance (24 hrs @ temperature) | | | | | | |
| 70 F. | C | C | C | | | Sep |
| 35 F. | C | CL | CL | | | |
| 0 F. | No Sep | No Sep | No Sep | Sep | Sep | Sep |

Example 7

Lubrication Fluid Containing Perhydro-Alpha-Methylstyrene Dimer, Tri-Iso-$C_9$ Trimethoxylpropane Ester with or without Dimethylsiloxane, 20 cSt @ 77° F.

| Component | Wt. % | Wt. % | Wt. % | Wt. % | Wt. % | Wt. % |
|---|---|---|---|---|---|---|
| Perhydro-alpha-Methylstyrene Dimer | 91.8 | 86.8 | 81.8 | 76.8 | 86.8 | 81.8 |
| Tri-i-C9 TMP ester | 5 | 5 | 5 | 5 | 10 | 10 |
| Dimethacone, 20 cSt @ 77 F. | | 5 | 10 | 15 | | 5 |
| Performance Additive Package | 3 | 3 | 3 | 3 | 3 | 3 |
| Anti-Foamant Package | 0.2 | 0.2 | 0.2 | 0.2 | 0.2 | 0.2 |
| | 100 | 100 | 100 | 100 | 100 | 100 |
| CS 40 C., cS | 20.27 | 19.22 | 18.16 | 17.29 | 20.96 | 19.50 |
| CS 100 C., cS | 3.680 | 3.788 | 3.857 | 3.940 | 3.800 | 3.856 |
| VI | 33.2 | 73.9 | 103.5 | 125.2 | 42.2 | 79.5 |
| Anton Paar SVM, −20 C., cP | 3696.2 | 2678.3 | 1711.6 | 1209.4 | 4352.4 | 2540.1 |
| Anton Paar SVM, −30 C., cP | 22538 | 14748 | 8956 | 6366 | 26690 | 13574 |
| Appearance | | | | | | |
| 70-75 F. | Clear, NS | Clear, NS | Clear, NS | Clear, NS | Clear, NS | Clear, NS |
| 35-40 F. | Clear, NS | Clear, NS | Clear, NS | Clear, NS | Clear, NS | Clear, NS |
| 0-5 F. | Clear, NS | Clear, NS | Clear, NS | Clear, NS | Clear, NS | Clear, NS |
| Component | Wt. % | Wt. % | Wt. % | Wt. % | Wt. % | Wt. % |
| Perhydro-alpha-Methylstyrene Dimer | 76.8 | 71.8 | 81.8 | 76.8 | 71.8 | 66.8 |

-continued

| | | | | | | |
|---|---|---|---|---|---|---|
| Tri-i-C9 TMP ester | 10 | 10 | 15 | 15 | 15 | 15 |
| Dimethacone, 20 cSt @ 77 F. | 10 | 15 | | 5 | 10 | 15 |
| Performance Additive Package | 3 | 3 | 3 | 3 | 3 | 3 |
| Anti-Foamant Package | 0.2 | 0.2 | 0.2 | 0.2 | 0.2 | 0.2 |
| | 100 | 100 | 100 | 100 | 100 | 100 |
| CS 40 C., cS | 18.62 | 17.73 | 21.49 | 20.17 | 19.06 | 18.26 |
| CS 100 C., cS | 3.934 | 4.023 | 3.886 | 3.956 | 4.017 | 4.123 |
| VI | 105.4 | 127.2 | 47.5 | 82.8 | 107.9 | 129.8 |
| Anton Paar SVM, −20 C., cP | 1701.7 | 1115.8 | 4223 | 2578.3 | 1652.2 | 1094.1 |
| Anton Paar SVM, −30 C., cP | 8369 | 5487 | 25637 | 13683 | 7833 | 4770 |
| Appearance | | | | | | |
| 70-75 F. | Clear, NS | Clear, NS | Clear, NS | Clear, NS | Clear, NS | Clear, NS |
| 35-40 F. | Clear, NS | Clear, NS | Clear, NS | Clear, NS | Clear, NS | Clear, NS |
| 0-5 F. | Clear, NS | Clear, NS | Clear, NS | Clear, NS | Clear, NS | Clear, NS |

| Component | Wt. % | Wt. % | Wt. % | Wt. % | Wt. % | Wt. % |
|---|---|---|---|---|---|---|
| Perhydro-alpha-Methylstyrene Dimer | 91.8 | 86.8 | 81.8 | 76.8 | 86.8 | 81.8 |
| Tri-i-C9 TMP ester | 5 | 5 | 5 | 5 | 10 | 10 |
| Dimethacone, 30 cSt @ 77 F. | | 5 | 10 | 15 | | 5 |
| Performance Additive Package | 3 | 3 | 3 | 3 | 3 | 3 |
| Anti-Foamant Package | 0.2 | 0.2 | 0.2 | 0.2 | 0.2 | 0.2 |
| | 100 | 100 | 100 | 100 | 100 | 100 |
| CS 40 C., cS | 20.27 | 19.74 | 19.14 | 18.72 | 20.96 | 20.16 |
| CS 100 C., cS | 3.680 | 3.875 | 4.029 | 4.171 | 3.800 | 3.956 |
| VI | 33.2 | 78.1 | 108.0 | 128.1 | 42.2 | 83.2 |
| Anton Paar SVM, −20 C., cP | 3696.2 | — | — | — | 4352.4 | — |
| Anton Paar SVM, −30 C., cP | 22538 | — | — | — | 26690 | — |
| Appearance | | | | | | |
| 70-75 F. | Clear, NS | Clear, NS | Clear, NS | Clear, NS | Clear, NS | Clear, NS |
| 35-40 F. | Clear, NS | Clear, NS | Clear, NS | Clear, NS | Clear, NS | Clear, NS |
| 0-5 F. | Clear, NS | Cldy, NS | Cldy, NS | Cldy, NS | Clear, NS | Cldy, NS |

| Component | Wt. % | Wt. % | Wt. % | Wt. % | Wt. % | Wt. % |
|---|---|---|---|---|---|---|
| Perhydro-alpha-Methylstyrene Dimer | 76.8 | 71.8 | 81.8 | 76.8 | 71.8 | 66.8 |
| Tri-i-C9 TMP ester | 10 | 10 | 15 | 15 | 15 | 15 |
| Dimethacone, 30 cSt @ 77 F. | 10 | 15 | | 5 | 10 | 15 |
| Performance Additive Package | 3 | 3 | 3 | 3 | 3 | 3 |
| Anti-Foamant Package | 0.2 | 0.2 | 0.2 | 0.2 | 0.2 | 0.2 |
| | 100 | 100 | 100 | 100 | 100 | 100 |
| CS 40 C., cS | 19.6 | 19.19 | 21.49 | 20.66 | 20.21 | 19.81 |
| CS 100 C., cS | 4.123 | 4.311 | 3.886 | 4.069 | 4.238 | 4.454 |
| VI | 111.3 | 135.4 | 47.5 | 91.1 | 114.9 | 140.9 |
| Anton Paar SVM, −20 C., cP | — | — | 4223 | 2656 | — | — |
| Anton Paar SVM, −30 C., cP | — | — | 25637 | 14165 | — | — |
| Appearance | | | | | | |
| 70-75 F. | Clear, NS | Clear, NS | Clear, NS | Clear, NS | Clear, NS | Clear, NS |
| 35-40 F. | Clear, NS | Clear, NS | Clear, NS | Clear, NS | Clear, NS | Clear, NS |
| 0-5 F. | Cldy, NS | Cldy, NS | Clear, NS | Clear, NS | Cldy, NS | Cldy, NS |

Example 8

Lubrication Fluid Containing Perhydro-Alpha-Methylstyrene Dimer, Tri-Iso-$C_9$ Tpentaerithritol Ester with or without Dimethylsiloxane, 20 cSt @ 77° F.

| Component | Wt. % | Wt. % | Wt. % | Wt. % | Wt. % | Wt. % | Wt. % | Wt. % | Wt. % |
|---|---|---|---|---|---|---|---|---|---|
| Perhydro-alpha-Methylstyrene Dimer | 91.8 | 86.8 | 81.8 | 76.8 | 71.8 | 66.8 | 86.8 | 81.8 | 76.8 |
| Tetra-i-C9 PE ester | 5 | 5 | 5 | 5 | 5 | 5 | 10 | 10 | 10 |
| Dimethacone, 20 cSt @ 77 F. | | 5 | 10 | 15 | 20 | 25 | | 5 | 10 |
| Performance Additive Package | 3 | 3 | 3 | 3 | 3 | 3 | 3 | 3 | 3 |
| Anti-Foamant Package | 0.2 | 0.2 | 0.2 | 0.2 | 0.2 | 0.2 | 0.2 | 0.2 | 0.2 |
| | 100 | 100 | 100 | 100 | 100 | 100 | 100 | 100 | 100 |
| CS 40 C., cS | 12.65 | 19.31 | | | | | 21.53 | 20.15 | |
| CS 100 C., cS | 3.95 | 3.85 | | | | | 3.92 | 3.98 | |
| VI | 56 | 81.7 | | | | | 51.7 | 86.6 | |
| Anton Paar SVM, −20 C., cP | 4601 | 2702.8 | | | | | 3734.9 | 2280.1 | |
| Anton Paar SVM, −30 C., cP | 27745 | 14793 | | | | | 21392 | 11614 | |
| Appearance | | | | | | | | | |
| 70-75 F. | clear NS | clear NS | clear NS | clear NS | clear NS | clear NS | clear NS | clear NS | clear NS |
| 35-40 F. | clear NS | clear NS | clear NS | clear NS | clear NS | clear NS | clear NS | clear NS | clear NS |
| 0-5 F. | clear NS | clear NS | cldy NS | cldy SEP | cldy SEP | cldy SEP | clear NS | clear NS | cldy NS |

| Component | Wt. % | Wt. % | Wt. % | Wt. % | Wt. % | Wt. % | Wt. % | Wt. % | Wt. % |
|---|---|---|---|---|---|---|---|---|---|
| Perhydro-alpha-Methylstyrene Dimer | 71.8 | 66.8 | 61.8 | 81.8 | 76.8 | 71.8 | 66.8 | 61.8 | 56.8 |
| Tetra-i-C9 PE ester | 10 | 10 | 10 | 15 | 15 | 15 | 15 | 15 | 15 |
| Dimethacone, 20 cSt @ 77 F. | 15 | 20 | 25 | | 5 | 10 | 15 | 20 | 25 |
| Performance Additive Package | 3 | 3 | 3 | 3 | 3 | 3 | 3 | 3 | 3 |
| Anti-Foamant Package | 0.2 | 0.2 | 0.2 | 0.2 | 0.2 | 0.2 | 0.2 | 0.2 | 0.2 |
| | 100 | 100 | 100 | 100 | 100 | 100 | 100 | 100 | 100 |
| CS 40 C., cS | | | | 22.07 | 20.68 | | | | |
| CS 100 C., cS | | | | 4.04 | 4.1 | | | | |
| VI | | | | 62.3 | 95.2 | | | | |
| Anton Paar SVM, −20 C., cP | | | | 3191.2 | 2048 | | | | |
| Anton Paar SVM, −30 C., cP | | | | 17219 | 9830 | | | | |
| Appearance | | | | | | | | | |
| 70-75 F. | clear NS | clear NS | clear NS | clear NS | clear NS | clear NS | clear NS | clear NS | clear NS |
| 35-40 F. | clear NS | clear NS | clear NS | clear NS | clear NS | clear NS | clear NS | clear NS | clear NS |
| 0-5 F. | cldy SEP | cldy SEP | cldy SEP | clear NS | clear NS | cldy NS | cldy SEP | cldy SEP | cldy SEP |

| Component | Wt. % | Wt. % | Wt. % | Wt. % | Wt. % | Wt. % | Wt. % | Wt. % | Wt. % |
|---|---|---|---|---|---|---|---|---|---|
| Perhydro-alpha-Methylstyrene Dimer | 91.8 | 86.8 | 81.8 | 76.8 | 71.8 | 66.8 | 86.8 | 81.8 | 76.8 |
| Tetra-i-C9 PE ester | 5 | 5 | 5 | 5 | 5 | 5 | 10 | 10 | 10 |
| Dimethacone, 20 cSt @ 77 F. | | 5 | 10 | 15 | 20 | 25 | | 5 | 10 |

-continued

| | | | | | | | | | |
|---|---|---|---|---|---|---|---|---|---|
| Performance Additive Package | 3 | 3 | 3 | 3 | 3 | 3 | 3 | 3 | 3 |
| Anti-Foamant Package | 0.2 | 0.2 | 0.2 | 0.2 | 0.2 | 0.2 | 0.2 | 0.2 | 0.2 |
| | 100 | 100 | 100 | 100 | 100 | 100 | 100 | 100 | 100 |
| CS 40 C., cS | 20.63 | | | | | | 21.57 | | |
| CS 100 C., cS | 3.78 | | | | | | 3.92 | | |
| VI | 44.1 | | | | | | 51.7 | | |
| Anton Paar SVM, −20 C., cP | 4324 | | | | | | 2902 | | |
| Anton Paar SVM, −30 C., cP | 25671 | | | | | | 16225 | | |
| Appearance | | | | | | | | | |
| 70-75 F. | clear NS | clear NS | clear NS | clear NS | clear NS | clear NS | clear NS | clear NS | clear NS |
| 35-40 F. | clear NS | cldy NS | cldy NS | cldy NS | cldy SEP | cldy SEP | clear NS | clear NS | cldy NS |
| 0-5 F. | clear NS | cldy NS | cldy NS | cldy NS | cldy SEP | cldy SEP | clear NS | cldy NS | cldy NS |
| Component | Wt. % | Wt. % | Wt. % | Wt. % | Wt. % | Wt. % | Wt. % | Wt. % | Wt. % |
| Perhydro-alpha-Methylstyrene Dimer | 71.8 | 66.8 | 61.8 | 81.8 | 76.8 | 71.8 | 66.8 | 61.8 | 56.8 |
| Tetra-i-C9 PE ester | 10 | 10 | 10 | 15 | 15 | 15 | 15 | 15 | 15 |
| Dimethacone, 20 cSt @ 77 F. | 15 | 20 | 25 | | 5 | 10 | 15 | 20 | 25 |
| Performance Additive Package | 3 | 3 | 3 | 3 | 3 | 3 | 3 | 3 | 3 |
| Anti-Foamant Package | 0.2 | 0.2 | 0.2 | 0.2 | 0.2 | 0.2 | 0.2 | 0.2 | 0.2 |
| | 100 | 100 | 100 | 100 | 100 | 100 | 100 | 100 | 100 |
| CS 40 C., cS | | | | 21.48 | | | | | |
| CS 100 C., cS | | | | 3.98 | | | | | |
| VI | | | | 63.1 | | | | | |
| Anton Paar SVM, −20 C., cP | | | | 3122 | | | | | |
| Anton Paar SVM, −30 C., cP | | | | 16896 | | | | | |
| Appearance | | | | | | | | | |
| 70-75 F. | clear NS | clear NS | clear NS | clear NS | clear NS | clear NS | clear NS | clear NS | clear NS |
| 35-40 F. | cldy NS | cldy SEP | cldy SEP | cldy NS | cldy NS | cldy NS | cldy SEP | cldy SEP | cldy SEP |
| 0-5 F. | cldy SEP | cldy SEP | cldy SEP | clear NS | cldy NS | cldy SEP | cldy SEP | cldy SEP | cldy SEP |
| Component | Wt. % | Wt. % | Wt. % | Wt. % | Wt. % | Wt. % | Wt. % | Wt. % | Wt. % |
| Perhydro-alpha-Methylstyrene Dimer | 91.8 | 86.8 | 81.8 | 76.8 | 71.8 | 66.8 | 86.8 | 81.8 | 76.8 |
| Tetra-i-C9 PE ester | 5 | 5 | 5 | 5 | 5 | 5 | 10 | 10 | 10 |
| Dimethacone, 20 cSt @ 77 F. | | 5 | 10 | 15 | 20 | 25 | | 5 | 10 |
| Performance Additive Package | 3 | 3 | 3 | 3 | 3 | 3 | 3 | 3 | 3 |
| Anti-Foamant Package | 0.2 | 0.2 | 0.2 | 0.2 | 0.2 | 0.2 | 0.2 | 0.2 | 0.2 |
| | 100 | 100 | 100 | 100 | 100 | 100 | 100 | 100 | 100 |
| CS 40 C., cS | 20.5 | | | | | | 20.93 | | |
| CS 100 C., cS | 3.74 | | | | | | 3.85 | | |
| VI | 40.8 | | | | | | 52.2 | | |
| Anton Paar SVM, −20 C., cP | 4027 | | | | | | 3540 | | |
| Anton Paar SVM, −30 C., cP | 24316 | | | | | | 20279 | | |
| Appearance | | | | | | | | | |
| 70-75 F. | clear NS | clear NS | clear NS | clear NS | clear NS | cldy NS | clear NS | cldy NS | cldy SEP |
| 35-40 F. | clear NS | cldy SEP | cldy SEP | cldy SEP | cldy SEP | cldy SEP | clear NS | cldy NS | cldy SEP |
| 0-5 F. | clear NS | cldy SEP | cldy SEP | cldy SEP | cldy SEP | cldy SEP | clear NS | cldy SEP | cldy SEP |

-continued

| Component | Wt. % | Wt. % | Wt. % | Wt. % | Wt. % | Wt. % | Wt. % | Wt. % | Wt. % |
|---|---|---|---|---|---|---|---|---|---|
| Perhydro-alpha-Methylstyrene Dimer | 71.8 | 66.8 | 61.8 | 81.8 | 76.8 | 71.8 | 66.8 | 61.8 | 56.8 |
| Tetra-i-C9 PE ester | 10 | 10 | 10 | 15 | 15 | 15 | 15 | 15 | 15 |
| Dimethacone, 20 cSt @ 77 F. | 15 | 20 | 25 | | 5 | 10 | 15 | 20 | 25 |
| Performance Additive Package | 3 | 3 | 3 | 3 | 3 | 3 | 3 | 3 | 3 |
| Anti-Foamant Package | 0.2 | 0.2 | 0.2 | 0.2 | 0.2 | 0.2 | 0.2 | 0.2 | 0.2 |
| | 100 | 100 | 100 | 100 | 100 | 100 | 100 | 100 | 100 |
| CS 40 C., cS | | | | 21.46 | | | | | |
| CS 100 C., cS | | | | 3.98 | | | | | |
| VI | | | | 63.1 | | | | | |
| Anton Paar SVM, −20 C., cP | | | | 3150 | | | | | |
| Anton Paar SVM, −30 C., cP | | | | 17197 | | | | | |
| Appearance | | | | | | | | | |
| 70-75 F. | cldy SEP | cldy SEP | cldy NS | clear NS | cldy NS | cldy SEP | cldy SEP | cldy SEP | cldy NS |
| 35-40 F. | cldy SEP | cldy SEP | cldy SEP | clear NS | cldy SEP | cldy SEP | cldy SEP | cldy SEP | cldy SEP |
| 0-5 F. | cldy SEP | cldy SEP | cldy SEP | clear NS | cldy SEP | cldy SEP | cldy SEP | cldy SEP | cldy SEP |

It will be appreciated by those skilled in the art that changes could be made to the exemplary embodiments shown and described above without departing from the broad inventive concept thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and features of the disclosed embodiments may be combined. Accordingly, reference should be made to the appended claims, rather than the foregoing specification, as indicating the scope of the disclosure. Unless specifically set forth herein, the terms "a", "an" and "the" are not limited to one element but instead should be read as meaning "at least one".

What is claimed:

1. A lubrication fluid comprising: a polycyclic hydrocarbon fluid and a dimethylsiloxane compound having a viscosity range of 20 cSt at 77° F. to 50 cSt at 77° F. F., wherein said dimethylsiloxane compound is present in an amount ranging from 0.1 wt. % and 25 wt. % based on the lubricating fluid, and said dimethylsiloxane fluid contains not more than 10 wt. % of functional groups other than methyl functional groups, wherein the polycyclic hydrocarbon fluid is a linear perhydro dimer of alpha-methylstyrene.

2. A lubrication fluid comprising: a polycyclic hydrocarbon fluid; a polypropyleneoxide composition present in an amount ranging from 0.1 wt. % to 25 wt. % of the lubricating fluid; and a dimethylsiloxane compound having a viscosity range of 20 cSt at 77° F. to 50 cSt at 77° F., wherein said dimethylsiloxane compound is present in an amount ranging from 0.1 wt. % and 25 wt. % based on the lubricating fluid, and said dimethylsiloxane fluid contains not more than 10 wt. % of functional groups other than methyl functional groups, wherein the polycyclic hydrocarbon fluid is a linear perhydro dimer of alpha-methylstyrene.

3. The lubrication fluid according to claim 2, wherein the polypropyleneoxide composition corresponds to di-alkyl or di-cycloalkyl or alkyl-cycloalkyl, or mixtures thereof, of di-end-capped polypropylene oxides.

4. A lubrication fluid comprising: a polycyclic hydrocarbon fluid; an ester compound selected from the group consisting of a branched alkyl ester, a cycloester, a cycloalkyl ester and combinations thereof, wherein said ester compound is present in an amount ranging from 0.1 wt. % to 25 wt. %; and a dimethylsiloxane compound having a viscosity range of 20 cSt at 77° F. to 50 cSt at 77° F., wherein said dimethylsiloxane compound is present in an amount ranging from 0.1 wt. % and 25 wt. % based on the lubricating fluid, and said dimethylsiloxane fluid contains not more than 10 wt. % of functional groups other than methyl functional groups, wherein the polycyclic hydrocarbon fluid is a linear perhydro dimer of alpha-methylstyrene.

5. The lubrication fluid according to claim 4, wherein the branched alkyl ester has 6 to 12 carbon atoms in a branched alkyl group and 3 to 4 ester groups.

6. The lubrication fluid according to claim 5, wherein the branched alkyl ester has at least two methyl groups distributed along a backbone of the branched alkyl ester.

7. The lubrication fluid according to claim 6, wherein the branched alkyl ester is trimethylhexane trimethoxypropane ester.

8. The lubrication fluid according to claim 6, wherein the branched alkyl ester is trimethylhexane pentaerythritol ester.

* * * * *